US012716182B2

(12) United States Patent
Mesa et al.

(10) Patent No.: US 12,716,182 B2
(45) Date of Patent: Aug. 25, 2026

(54) BARRIER INCLUDING STRAP WITH STRAP RETENTION MECHANISM

(71) Applicant: McCue Corporation, Danvers, MA (US)

(72) Inventors: Teodoro A. Mesa, Lynn, MA (US); Thomas Ustach, Boston, MA (US)

(73) Assignee: McCue Corporation, Danvers, MA (US)

( * ) Notice: Subject to any disclaimer, the term of this patent is extended or adjusted under 35 U.S.C. 154(b) by 281 days.

(21) Appl. No.: 18/276,701

(22) PCT Filed: Mar. 2, 2022

(86) PCT No.: PCT/US2022/018518
§ 371 (c)(1),
(2) Date: Aug. 10, 2023

(87) PCT Pub. No.: WO2022/187360
PCT Pub. Date: Sep. 9, 2022

(65) Prior Publication Data

US 2024/0133138 A1 Apr. 25, 2024
US 2024/0229387 A9 Jul. 11, 2024

Related U.S. Application Data

(60) Provisional application No. 63/155,566, filed on Mar. 2, 2021.

(51) Int. Cl.
*E01F 15/14* (2006.01)

(52) U.S. Cl.
CPC ..... *E01F 15/141* (2013.01)

(58) Field of Classification Search
CPC ... E01F 15/04; E01F 15/0453; E01F 15/0461; E01F 15/08; E01F 15/086; E01F 15/088;
(Continued)

(56) References Cited

U.S. PATENT DOCUMENTS 3,747,288 A 7/1973 Grimelii
4,553,875 A * 11/1985 Casey ..... E01F 15/083 404/9

(Continued)

FOREIGN PATENT DOCUMENTS

EP 2418325 A2 * 2/2012 ..... E01F 15/146
FR 2439269 A1 * 5/1980 ..... E01F 15/086
GB 1031111 A * 5/1966 ..... E01F 15/088

OTHER PUBLICATIONS

"Clamp." Collins Dictionary. [online], [retrieved on Dec. 1, 2026]. Retrieved from the Internet <URL: https://www.collinsdictionary.com/us/dictionary/english/clamp>.*

(Continued)

*Primary Examiner* — Josh Skroupa
(74) *Attorney, Agent, or Firm* — Young Basile Hanlon & MacFarlane, P.C.

(57) ABSTRACT

A protective barrier includes a first rail receiving member, a second rail receiving member, a rail extending between the first rail receiving member and the second rail receiving member, the rail having ends received by the first rail receiving member and the second rail receiving member, and a strap system extending between the first rail receiving member and the second rail receiving member and through the rail, the strap system including a first strap retaining mechanism including a clamp for securing a first distal end of a strap within the protective barrier.

11 Claims, 9 Drawing Sheets

(58) Field of Classification Search
CPC ..... E01F 15/14; E01F 15/141; E01F 15/145; E01F 15/146; E04H 17/1413; E04H 17/1465; E04H 17/22; Y10S 256/06
USPC ..... 256/1, DIG. 6; 404/6, 9
See application file for complete search history.

(56) References Cited

U.S. PATENT DOCUMENTS

| | | | | |
|---|---|---|---|---|
| 8,777,510 | B2 * | 7/2014 | Maus | E01F 15/145<br>404/6 |
| 10,060,154 | B2 | 8/2018 | McCue et al. | |
| 11,187,005 | B2 * | 11/2021 | McCue | E01F 15/141 |
| 2013/0248791 | A1 * | 9/2013 | Bullock | E01F 15/085<br>256/13.1 |
| 2018/0283040 | A1 | 10/2018 | McCue et al. | |
| 2020/0115864 | A1 * | 4/2020 | Mesa | E01F 15/146 |
| 2021/0102351 | A1 * | 4/2021 | Mesa | E01F 15/141 |

OTHER PUBLICATIONS

International Search Report, PCT Application No. PCT/US2022/018518, mailed May 18, 2022 (2 pages).

* cited by examiner

BARRIER INCLUDING STRAP WITH STRAP RETENTION MECHANISM

CROSS REFERENCE TO RELATED APPLICATIONS

This application is a U.S. National Phase Application of International Application No. PCT/US2022/018518, filed on Mar. 2, 2022, which claims the benefit of the filing date of U.S. Provisional Application 63/155,566 filed on Mar. 2, 2021, the contents of which is hereby incorporated by reference.

BACKGROUND OF THE INVENTION

This invention relates to a barrier with a strap system.

Warehouses, distributions centers, factories, and similar facilities often have large stock handling equipment such as fork trucks which frequently move stock into, out of, and around the facility. In some examples, the stock is stored on shelving (e.g., pallet racks) and stock handling equipment must navigate through the shelving to move stock to and from the shelving. Some facilities may have other obstacles (e.g., support columns, walls, pedestrian walkways) which the stock handling equipment must navigate around as it travels through the facility.

As an operator navigates stock handling equipment through a facility, it is possible for the operator to inadvertently cause the stock handling equipment to collide with obstacles such as shelving, support columns, or walls or to encroach on pedestrian walkways. When stock handling equipment collides with an obstacle, both the obstacle and the stock handling equipment can become damaged. In the case of shelving, a strong enough collision can cause the shelving to collapse. In the case of an encroachment on a pedestrian walkway, a pedestrian can be seriously injured.

Because of the dangers associated with stock handling equipment, barriers are often installed to protect obstacles and walkways in facilities from interactions with stock handling equipment.

SUMMARY OF THE INVENTION

Conventional barriers are often associated with a maximum load rating. If that maximum load rating is exceeded, conventional barriers fail. In the case of a catastrophic failure, parts of conventional barriers may break or separate in such a way that they are dangerously propelled into stock or pedestrians. Aspects described herein are directed to a strap system that prevents and mitigates catastrophic failure of barriers. The strap system includes strap retention mechanisms for securing distal ends of a strap within a barrier. This allows for easy and secure installation of any length of strap.

In a general aspect, a protective barrier includes a first rail receiving member, a second rail receiving member, a rail extending between the first rail receiving member and the second rail receiving member, the rail having ends received by the first rail receiving member and the second rail receiving member, and a strap system extending between the first rail receiving member and the second rail receiving member and through the rail, the strap system including a first strap retaining mechanism including a clamp for securing a first distal end of a strap within the protective barrier.

Aspects may include one or more of the following features. The first strap retaining mechanism may include a body with a clamping surface and a plate, the clamp comprising the plate and the clamping surface. Securing the first distal end of the strap within the protective barrier may include pressing a part of the first distal end of the strap against the clamping surface using the plate of the clamp. The plate may be attached to the first strap retaining member using one or more fasteners. The one or more fasteners may be used to advance the plate in a direction toward the clamping surface to press the part of the first distal end of the strap against the clamping surface using the plate.

The plate may include an opening configured to receive the first distal end of the strap. The body of the first strap retaining mechanism may include an opening for receiving the first distal end of the strap. The first strap retaining mechanism may be configured for attachment to a surface. The first strap retaining mechanism may include an attachment surface including one or more through holes through which a corresponding one or more fasteners extend to secure the first strap retaining mechanism to the surface. The protective barrier may include one or more elastic members configured to rest on the attachment surface with a corresponding one of the fasteners extending therethrough. Each of the one or more elastic members may have a washer disposed thereon and the elastic member is held captive between the washer and the attachment surface.

The first strap retaining mechanism may be disposed within the first rail receiving member. The protective barrier may include a second strap retaining mechanism for securing a second distal end of the strap, opposite the first distal end of the strap, within the protective barrier. The second strap retaining mechanism may be disposed within the second rail receiving member. The first rail receiving member may include a covered opening for providing access to the first strap retaining mechanism.

Other features and advantages of the invention are apparent from the following description, and from the claims.

DETAILED DESCRIPTION

1 Overview

Figure 1:
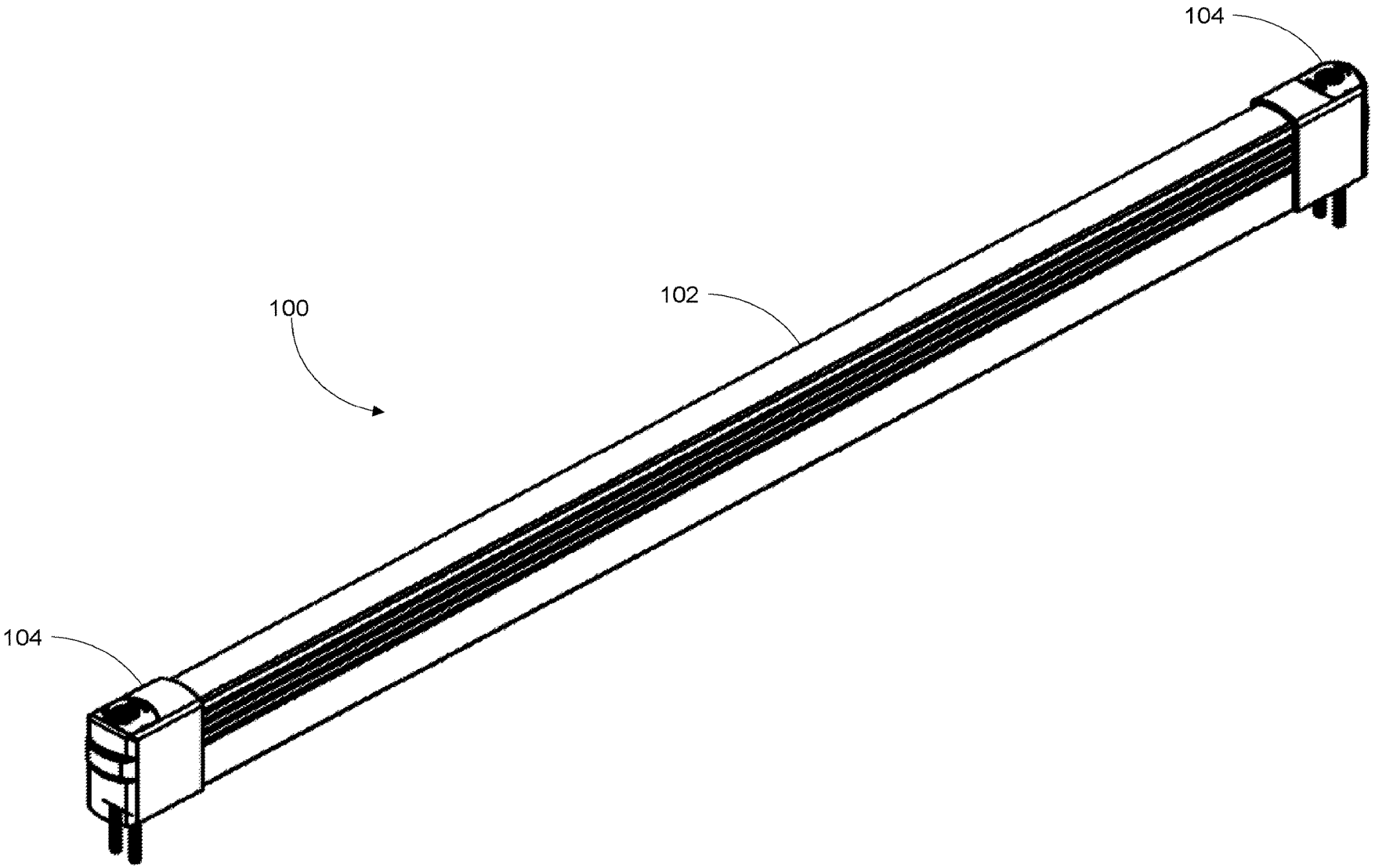
FIG. 1 is a first protective barrier.
Figure 2:
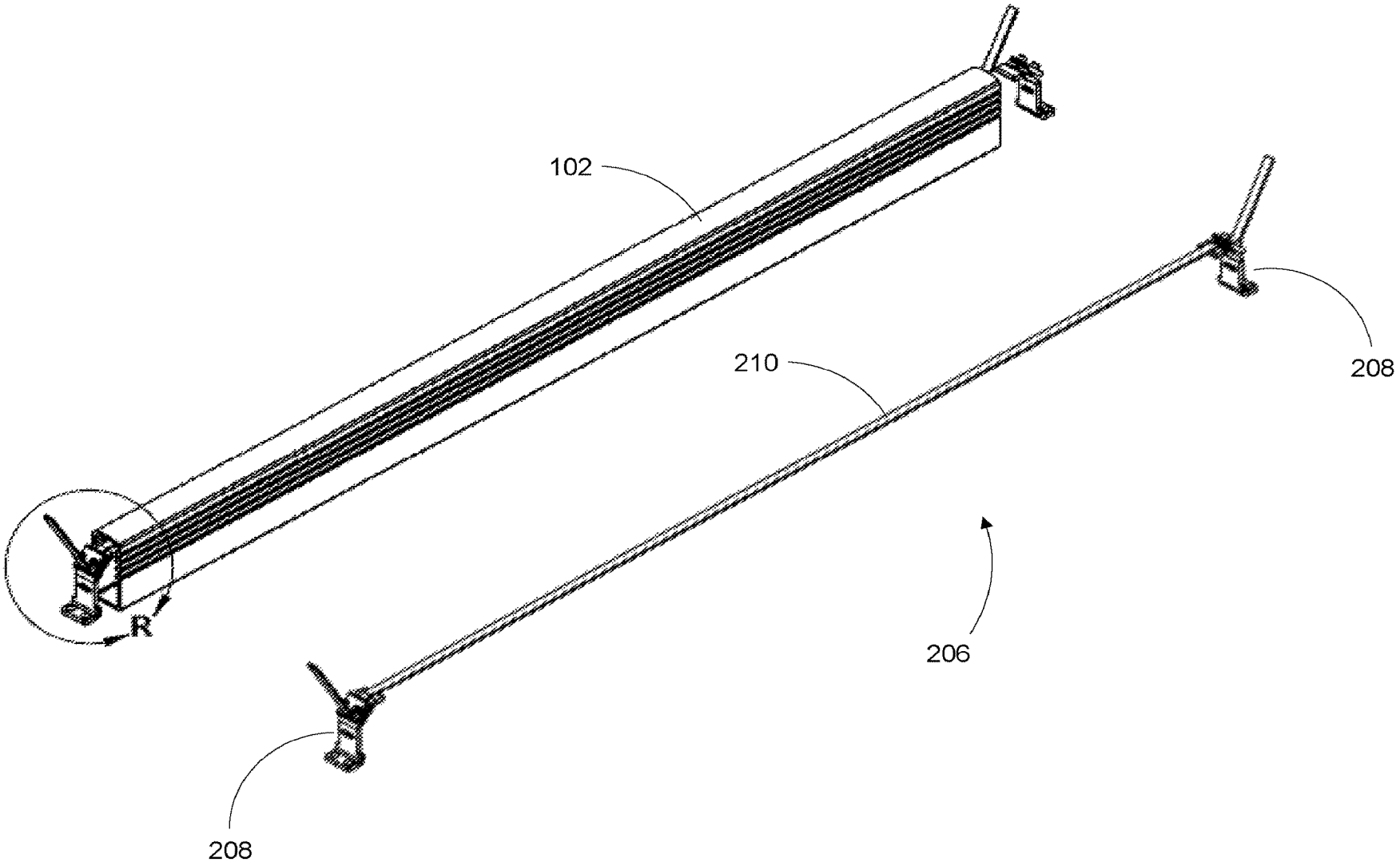
FIG. 2 shows a strap system of the first protective barrier of FIG. 1.
Figure 3:
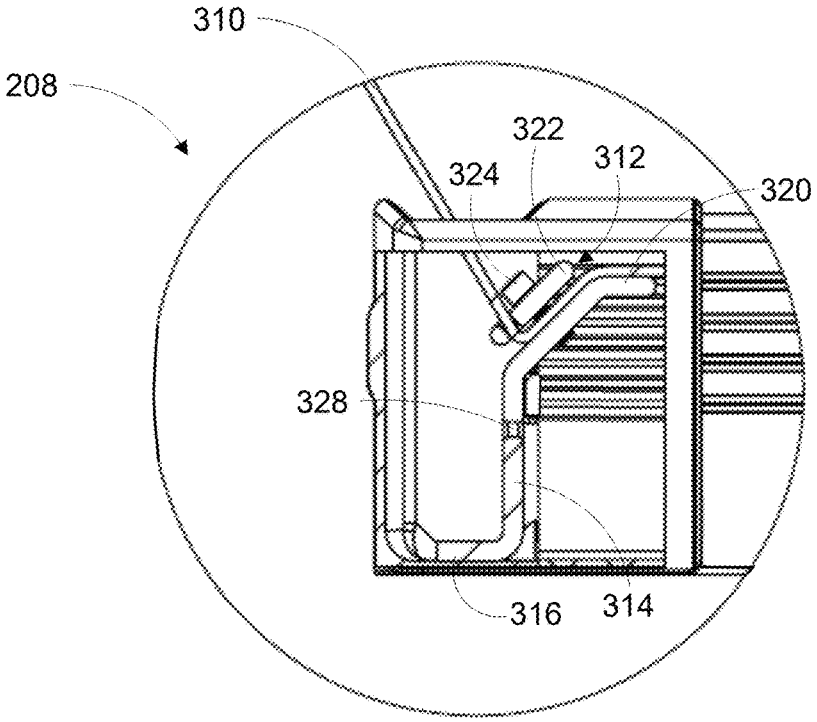
FIG. 3 is a side view of an end piece of the first protective barrier of FIG. 1.
Figure 4:
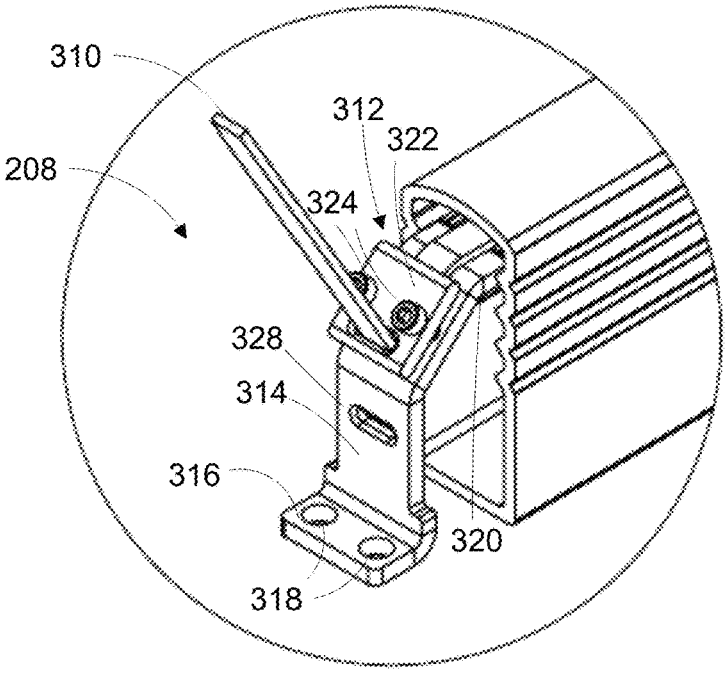
FIG. 4 is a perspective view of an end piece of the first protective barrier of FIG. 1.
Figure 5:
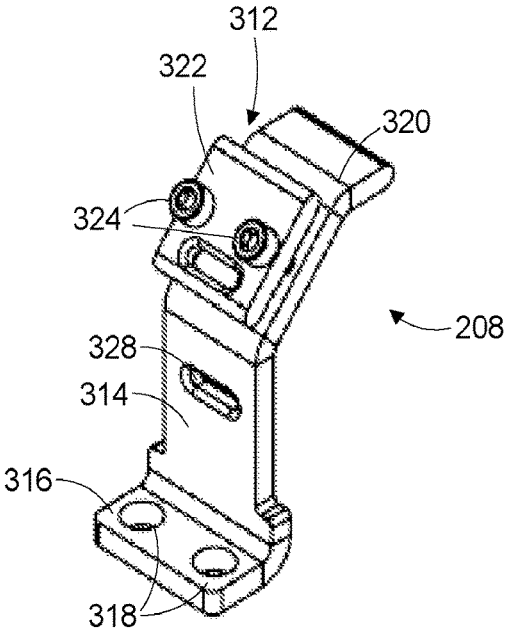
FIG. 5 is a perspective view of a strap retention mechanism.
Figure 6:
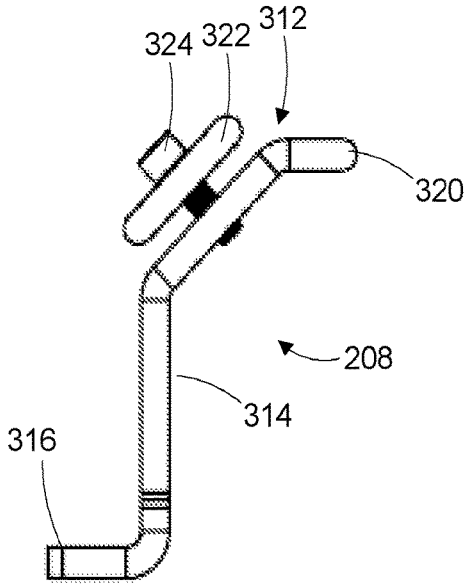
FIG. 6 is a side view of the strap retention mechanism of FIG. 5.

Referring to FIGS. 1 and 2, a barrier 100 includes a rail 102 extending between two end pieces 104, which are anchored to a surface. A strap system 206 extends between the end pieces 104 through the rail 102. The strap system 206 includes two strap retention mechanisms 208, each holding a different distal end of a strap 210. The strap retention mechanisms 208 are configured for installation inside the end pieces 104. The strap 210 is configured to extend through the rail 102.

Referring to FIGS. 3-6, the strap retention mechanism 208 includes an attachment flange 316, a strap retention portion 312, and an upright portion 314 extending between the attachment flange 316 and the strap retention portion 312. The strap retention portion 312 includes a curved strap support surface 320 and a friction plate 322 that is configured to be tightened down toward the strap support surface 320 using screws 324. The friction plate 322 includes a first opening 326 configured to receive a loose end of the strap 310. In general, the attachment flange 316 includes one or more through holes 318 for receiving fasteners to secure the attachment flange 316 to the surface. The upright portion 314 includes a second opening 328 for receiving a loose end of the strap 310.

In some examples, the barrier 100 is installed by positioning the end pieces 104 in their desired location and then positioning the strap retention mechanism 208 within the end pieces 104. Fasteners are inserted through the through holes 318 in the attachment flange 316, through openings in bottom surfaces of the end pieces 104 and secured into the surface. In some examples, the fasteners also extend through a shock absorber, as is described in greater detail below.

With the end pieces 104 and strap retention mechanisms 208 installed, the strap 119 (e.g., a nylon strap) is threaded through the rail 102 and installed in the strap retention mechanisms 208. To install the strap 310 in the strap retention mechanisms 208, each of the distal ends of the strap 310 is threaded between the curved strap support surface 320 and the friction plate 322 of a respective strap retention mechanism 208. The screws 324 are then tightened to move the friction plate 322 such that it pinches and holds the strap 310 (e.g., by friction) between the friction plate 322 and the curved strap support surface 320. The ends of the strap 310 are further secured by threading them through the first opening 326 in the friction plate 322 and then through the second opening 328 in the upright portion 314.

In some examples, one distal end of the strap 310 is fully installed in one of the strap retention mechanisms 208 prior to the other distal end being installed in another strap retention mechanism 208. This allows for effective tightening of the strap 310 during installation.

Figure 7:
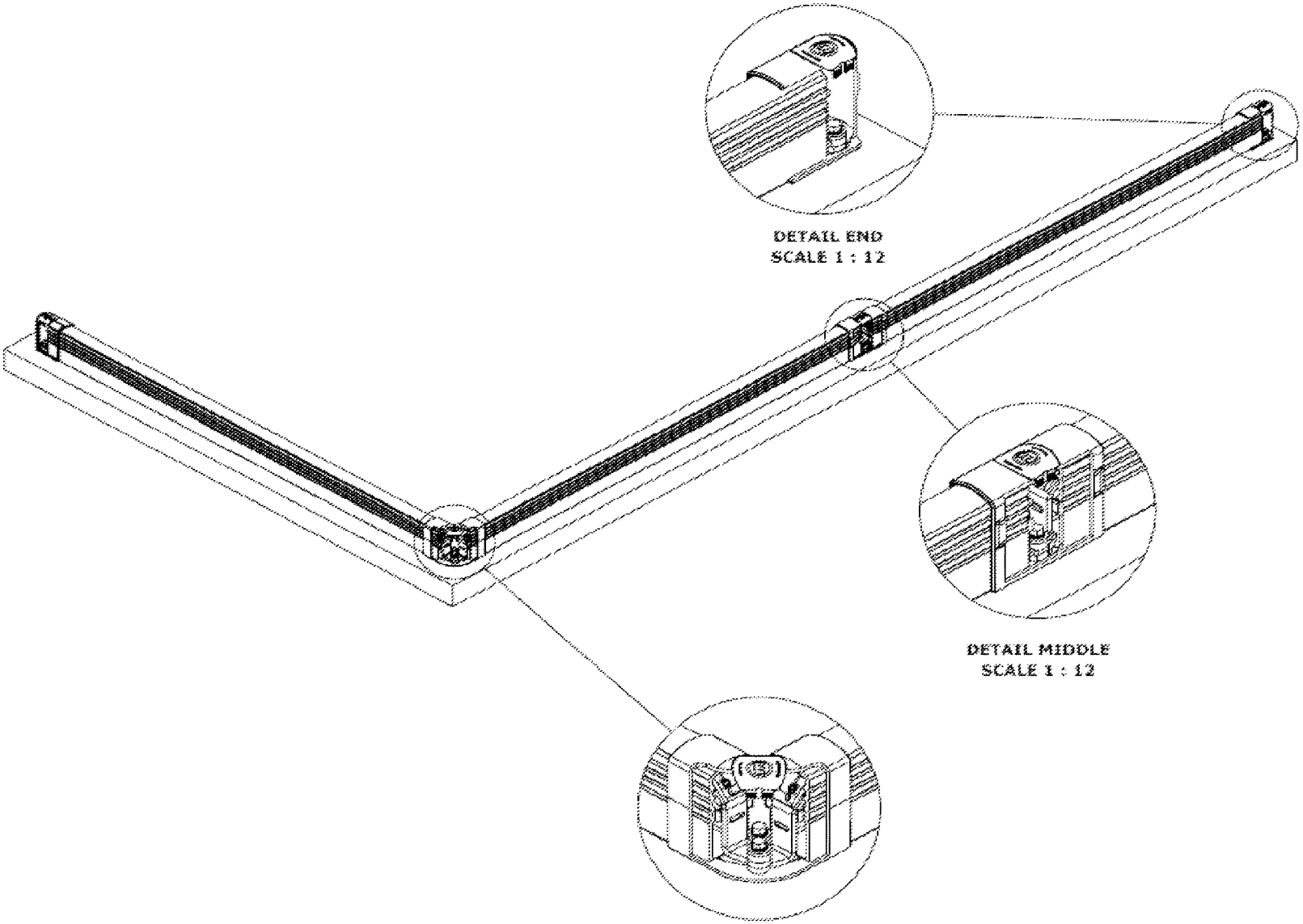
FIG. 7 is a second protective barrier.
Figure 8:
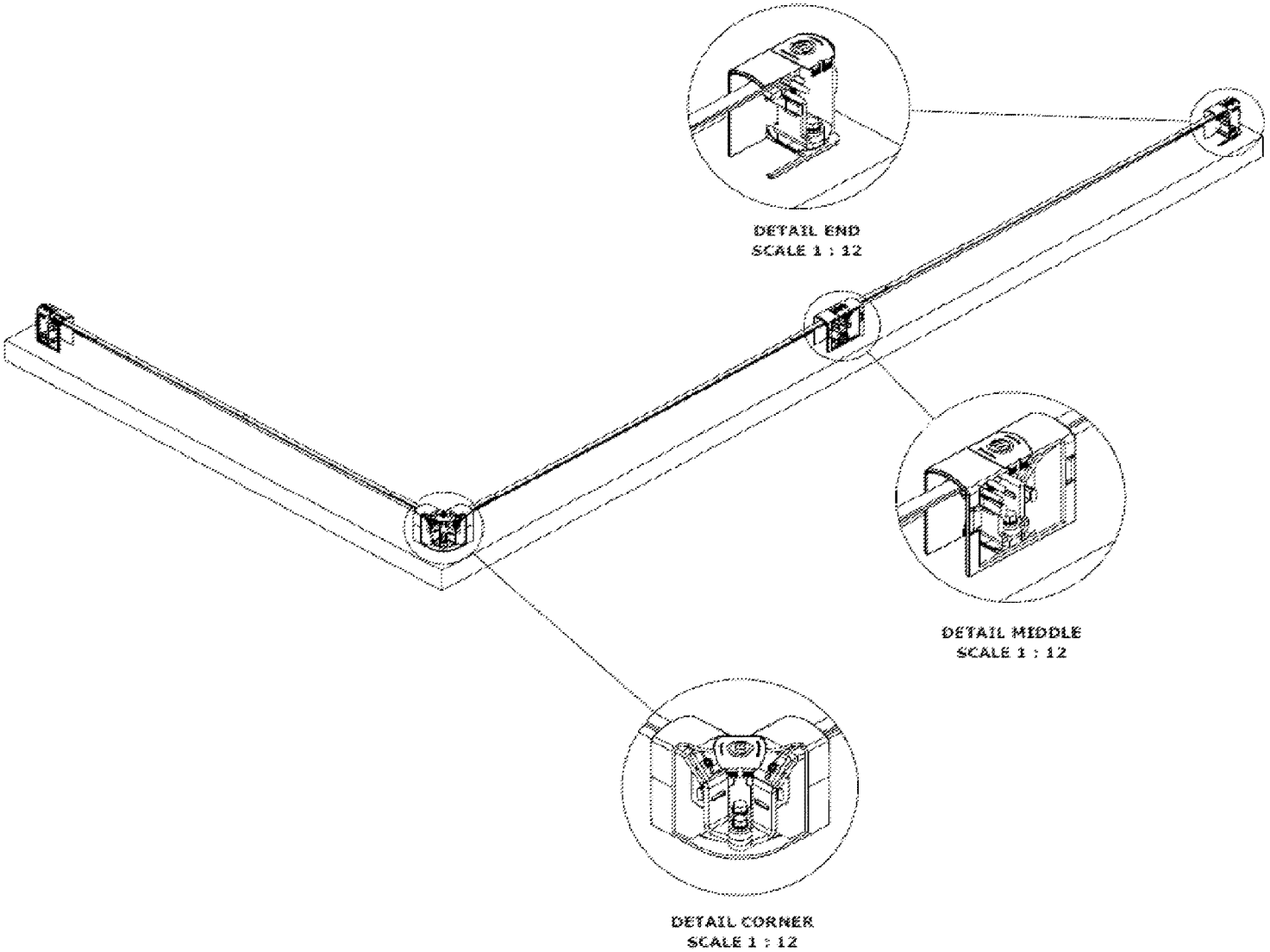
FIG. 8 shows a strap mechanism of the second protective barrier of FIG. 7.
Figure 9:
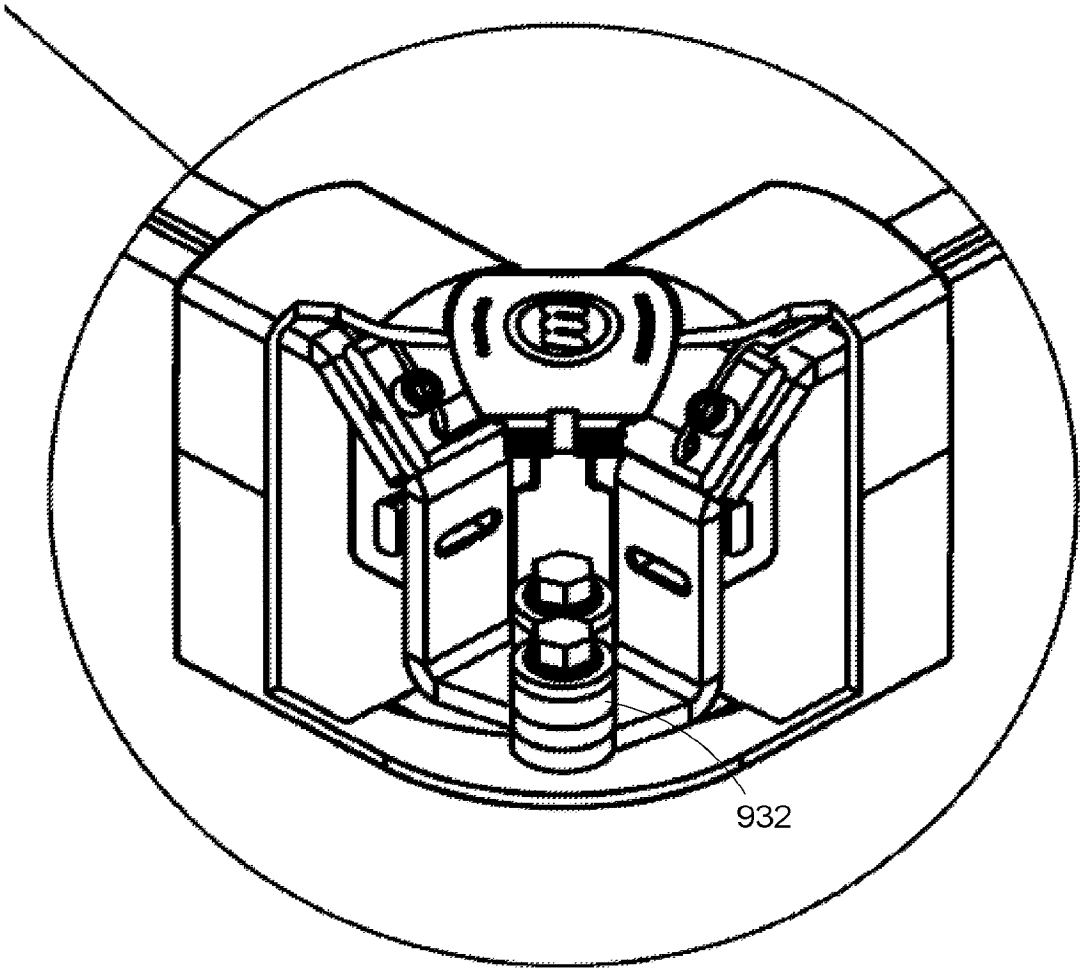
FIG. 9 is a cut-away view of a corner connector piece of the second protective barrier of FIG. 7.
Figure 10:
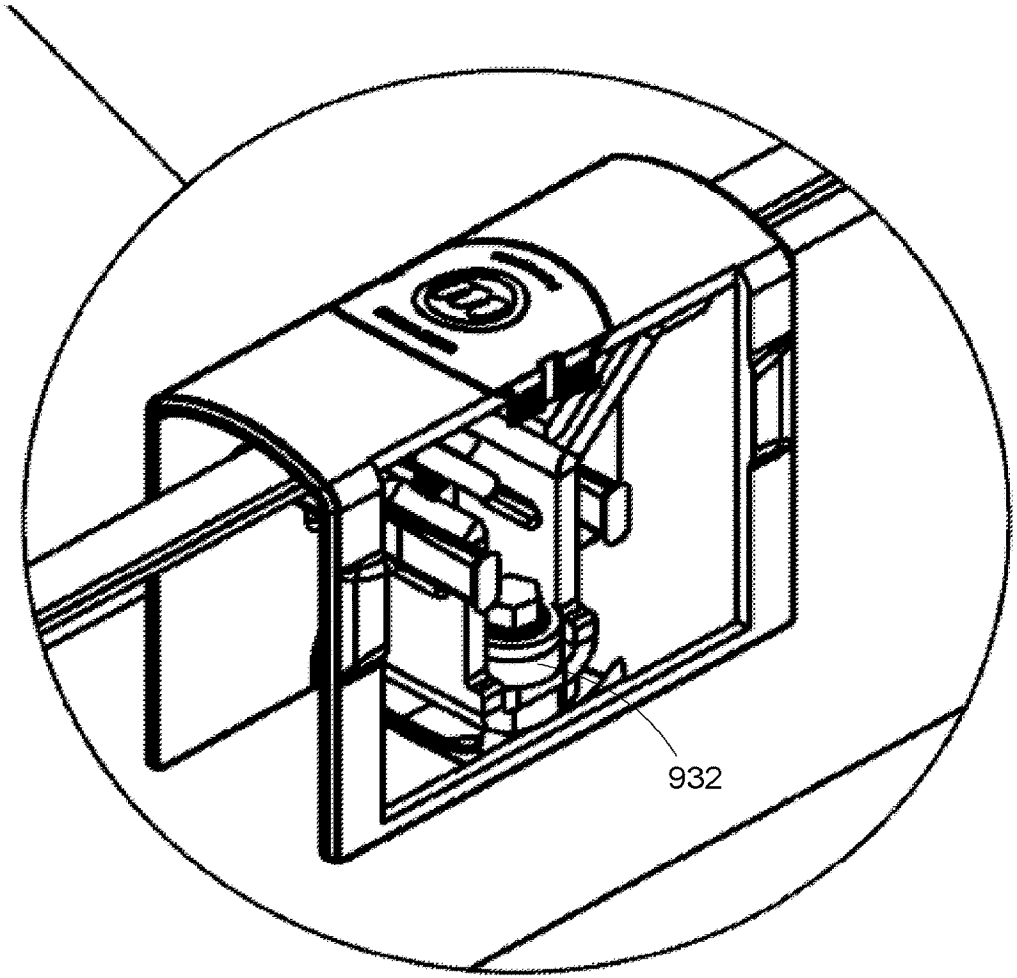
FIG. 10 is a cut-away view of a straight connector piece of the second protective barrier of FIG. 7.
Figure 11:
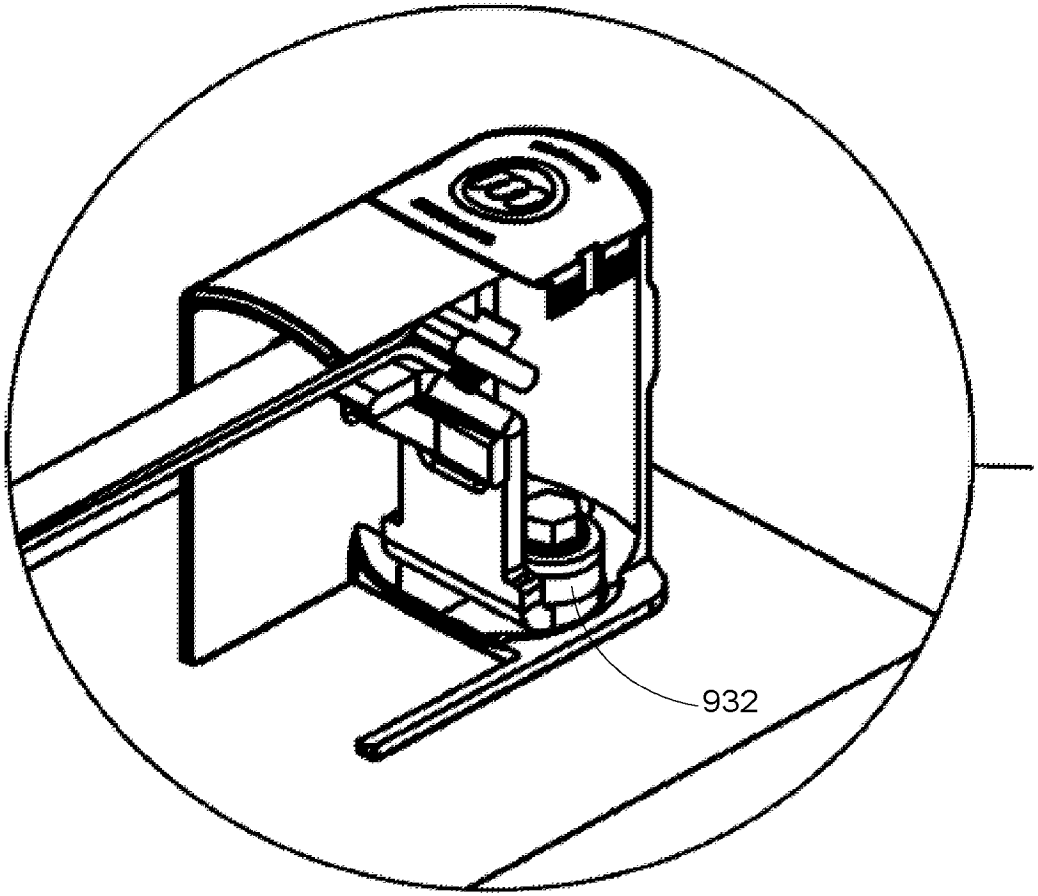
FIG. 11 is a cut-away view of an end piece of the second protective barrier of FIG. 7.

Referring to FIGS. 7-11, the strap system 206 can be used in multiple configurations, such as in longer, segmented barriers and barriers including angles (e.g., 90-degree turns) as in FIG. 7. In some examples, the attachment flange of the strap retention mechanisms is offset to accommodate different angles when used in angled barriers as in FIG. 9. In some examples, when two segments are connected end-to-end, the attachment flanges of the strap retention mechanisms are attached together and to the surface. As is mentioned above, in some examples the attachment flanges of the strap retention mechanisms are coupled to the surface using an impact absorber 932 as in FIGS. 9-11.

In some examples, the strap retention mechanisms are accessible through openings in the end pieces or other segment connecting pieces (e.g., center and angle connectors) of the barriers.

In some examples, only a single strap retention mechanism is used, and a fixed or relatively more permanent strap connection is used on the opposite end of the strap.

In one example, a protective barrier includes a first rail receiving member, a second rail receiving member, a rail extending between the first rail receiving member and the second rail receiving member, the rail having ends received by the first rail receiving member and the second rail receiving member, and a strap system extending between the first rail receiving member and the second rail receiving member and through the rail, the strap system including a first strap retaining mechanism including a clamp for securing a first distal end of a strap within the protective barrier.

In some examples, one or more of the following features may be included The first strap retaining mechanism may include a body with a clamping surface and a plate, the clamp comprising the plate and the clamping surface. Securing the first distal end of the strap within the protective barrier may include pressing a part of the first distal end of the strap against the clamping surface using the plate of the clamp. The plate may be attached to the first strap retaining member using one or more fasteners. The one or more fasteners may be used to advance the plate in a direction toward the clamping surface to press the part of the first distal end of the strap against the clamping surface using the plate.

The plate may include an opening configured to receive the first distal end of the strap. The body of the first strap retaining mechanism may include an opening for receiving the first distal end of the strap. The first strap retaining mechanism may be configured for attachment to a surface. The first strap retaining mechanism may include an attachment surface including one or more through holes through which a corresponding one or more fasteners extend to secure the first strap retaining mechanism to the surface. The protective barrier may include one or more elastic members configured to rest on the attachment surface with a corresponding one of the fasteners extending therethrough. In some examples, each of the one or more elastic members has a washer disposed thereon and the elastic member is held captive between the washer and the attachment surface.

The first strap retaining mechanism may be disposed within the first rail receiving member. The protective barrier may include a second strap retaining mechanism for securing a second distal end of the strap, opposite the first distal end of the strap, within the protective barrier. The second strap retaining mechanism may be disposed within the second rail receiving member. The first rail receiving member may include a covered opening for providing access to the first strap retaining mechanism.

A number of embodiments of the invention have been described. Nevertheless, it is to be understood that the foregoing description is intended to illustrate and not to limit the scope of the invention, which is defined by the scope of the following claims. Accordingly, other embodiments are also within the scope of the following claims. For example, various modifications may be made without departing from the scope of the invention. Additionally, some of the steps described above may be order independent, and thus can be performed in an order different from that described.

What is claimed is:

1. A protective barrier comprising:

a first rail receiving member;

a second rail receiving member;

a rail extending between the first rail receiving member and the second rail receiving member, the rail having ends received by the first rail receiving member and the second rail receiving member; and a strap system extending between the first rail receiving member and the second rail receiving member and through the rail, the strap system including a strap and a first strap retaining mechanism including a clamp for securing a first distal end of the strap within the protective barrier;

wherein the first strap retaining mechanism includes a body with a clamping surface and a plate, the clamp comprising the plate and the clamping surface, the plate is attached to the first strap retaining mechanism using one or more fasteners, and the one or more fasteners are used to advance the plate in a direction toward the clamping surface to press a part of the first distal end of the strap against the clamping surface using the plate.

2. The protective barrier of claim 1 wherein the plate includes an opening configured to receive the first distal end of the strap.

3. The protective barrier of claim 1 wherein the body of the first strap retaining mechanism includes an opening for receiving the first distal end of the strap.

4. The protective barrier of claim 1 wherein the first strap retaining mechanism is configured for attachment to a surface.

5. The protective barrier of claim 4 wherein the first strap retaining mechanism includes an attachment surface including one or more through holes through which a corresponding one or more fasteners extend to secure the first strap retaining mechanism to the surface.

6. The protective barrier of claim 5 further comprising one or more impact absorbers configured to rest on the attachment surface with a corresponding one of the fasteners extending therethrough.

7. The protective barrier of claim 6 wherein each of the one or more impact absorbers has a washer disposed thereon and the impact absorber is held captive between the washer and the attachment surface.

8. The protective barrier of claim 1 wherein the first strap retaining mechanism is disposed within the first rail receiving member.

9. The protective barrier of claim 1 further comprising a second strap retaining mechanism for securing a second distal end of the strap, opposite the first distal end of the strap, within the protective barrier.

10. The protective barrier of claim 9 wherein the second strap retaining mechanism is disposed within the second rail receiving member.

11. The protective barrier of claim 1 wherein the first rail receiving member includes a covered opening for providing access to the first strap retaining mechanism.

* * * * *